US006735995B2

(12) United States Patent
Shizu

(10) Patent No.: US 6,735,995 B2
(45) Date of Patent: May 18, 2004

(54) DEVICE AND METHOD FOR SHAPING CONDUCTOR MATERIAL INTO U-SHAPE BY BENDING THE SAME

(75) Inventor: Katsumi Shizu, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/007,230

(22) Filed: Nov. 7, 2001

(65) Prior Publication Data

US 2002/0059820 A1 May 23, 2002

(30) Foreign Application Priority Data

Nov. 17, 2000 (JP) ..... 2000-351439

(51) Int. Cl.[7] ..... B21P 11/00; B21P 7/02

(52) U.S. Cl. ..... 72/307; 72/217; 72/311; 72/403; 140/102

(58) Field of Search ..... 72/307, 215, 216, 72/217, 219, 308, 311, 321, 403; 140/90, 102, 71 R

(56) References Cited

U.S. PATENT DOCUMENTS

| | | | | | |
|---|---|---|---|---|---|
| 78,418 | A | * | 6/1868 | Boyd | 72/219 |
| 81,902 | A | * | 9/1868 | Heckart | 144/268 |
| 1,316,257 | A | * | 9/1919 | Snell | 140/104 |
| 2,535,328 | A | * | 12/1950 | Somerville | 72/217 |
| 2,828,542 | A | * | 3/1958 | Enghauser | 204/491 |
| 3,991,600 | A | * | 11/1976 | Del Fabro | 72/203 |
| 4,072,036 | A | * | 2/1978 | del Fabro | 140/105 |
| 4,248,273 | A | * | 2/1981 | Marcello | 140/105 |
| 4,546,632 | A | * | 10/1985 | Van Den Kieboom et al. | 492/1 |
| 4,916,929 | A | * | 4/1990 | Bihler | 72/203 |
| 4,989,429 | A | * | 2/1991 | Del Fabro et al. | 72/217 |
| 4,996,866 | A | * | 3/1991 | Masera et al. | 72/387 |
| 5,099,674 | A | * | 3/1992 | Nagel | 72/403 |
| 6,003,358 | A | * | 12/1999 | Lipari et al. | 72/14.8 |

* cited by examiner

*Primary Examiner*—Allen Ostrager
*Assistant Examiner*—John S Goetz
(74) *Attorney, Agent, or Firm*—Harness, Dickey & Pierce, PLC

(57) ABSTRACT

A shaping device for producing a U-shaped conductor includes a holding portion, a feeding portion, a core metal portion and a shaping portion. The core metal portion includes a core metal and an upper guide portion. The core metal forms a die. The upper guide portion restrains upward movement of the conductor material during the shaping operation. The shaping portion includes a shaping element and a lower guide. The shaping element shapes the conductor material into the U-shape by urging the conductor material along the core metal. The lower guide restrains downward movement of the conductor material during the shaping operation. It is possible to move the shaping element downwardly after the conductor material is shaped into the U-shape. The conductor material can be fed forward without returning the shaping element to its initial position.

24 Claims, 3 Drawing Sheets

DEVICE AND METHOD FOR SHAPING CONDUCTOR MATERIAL INTO U-SHAPE BY BENDING THE SAME

CROSS REFERENCE TO RELATED APPLICATION

This application is based on and incorporates herein by reference Japanese Patent Application No. 2000-351439 filed on Nov. 17, 2000.

BACKGROUND OF THE INVENTION

1. Field of the Invention

The present invention relates to a shaping device for shaping a conductor material into a U-shape by bending the same.

2. Description of Related Art

Various conductors have been used in various electric devices, and some conductors are shaped into a U-shape due to, for example, a limited installation space and/or other reasons. The conductors shaped into the U-shape will be hereinafter referred to as "U-shaped conductors". Such a U-shaped conductor is produced, for example, by bending a linear conductor material.

FIG. 4 depicts a structure of a previously proposed shaping device for producing the U-shaped conductor. As shown in FIG. 4, the previously proposed shaping device includes a conductor material holding portion 100, a core metal 110 and a shaping portion 120. A linear conductor material 200 held by the conductor material holding portion 100 is shaped into the U-shape along the fixed core metal 110 using the shaping portion 120. Then, the U-shaped conductor material is cut and is removed, so that the U-shaped conductor is produced.

In the above shaping device, a shaping element of the shaping portion 120 has a circumferential recess at its vertical center. The circumferential recess has a contour that corresponds to a cross-sectional shape of the conductor material 200. Upper and lower ridges of the shaping element located at upper and lower sides of the circumferential recess constitute upper and lower guides 122, 124 for restraining deformation of the conductor material 200 toward the upper and lower sides, respectively. Because of the guide 122, the shaping element cannot be moved downwardly right after shaping the conductor material 200 into the U-shape. Thus, an unshaped portion of the conductor material 200 cannot be fed forward since a path of the conductor material 200 is obstructed by the shaping element located in the path. Because of this reason, the shaping element needs to be returned to its initial position, and then the unshaped portion of the conductor material 200 is fed forward. This disadvantageously increases the time required for the conductor material 200 to be removed after the conductor material 200 is shaped into the U-shape.

SUMMARY OF THE INVENTION

The present invention addresses the above disadvantage. Thus, it is an objective of the present invention to provide a device and method for shaping a conductor material into a U-shape in a manner that allows reduction of time required for the conductor material to be removed after the conductor material is shaped into the U-shape.

To achieve the objective of the invention, there is provided a shaping device for shaping a conductor material into a U-shape, the shaping device includes a holding portion for holding the conductor material, a feeding portion for feeding the conductor material, a core metal portion forming a die that defines a shape and size of the conductor material when the conductor material is shaped into the U-shape, and a shaping portion for shaping the conductor material into the U-shape along the core metal portion. The core metal portion includes a core metal and a first guide portion. The core metal forms the die. The first guide portion restrains movement of the conductor material in a first direction when the conductor material is shaped into the U-shape. The shaping portion includes a shaping element and a second guide portion. The shaping element shapes the conductor material into the U-shape by urging the conductor material along at least a portion of the core metal. The second guide portion restrains movement of the conductor material in a second direction that is opposite to the first direction when the conductor material is shaped into the U-shape.

There is also provided a method for shaping a conductor material into a U-shape. The method includes steps of: positioning a core metal of a core metal portion to a predetermined operating position, and securing the conductor material fed to a predetermined position with use of a holding portion; shaping the conductor material into the U-shape by moving a shaping element of a shaping portion along a predetermined planar path such that the shaping element urges the conductor material along at least a portion of the core metal; moving the shaping element away from the conductor material in a direction substantially perpendicular to a plane in which the planar path of the shaping element is located, and returning the core metal to its initial position; and cutting and removing the conductor material that is shaped into the U-shape.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

A shaping device for producing a U-shaped conductor (hereinafter, referred to as "shaping device") according to one embodiment of the present invention will be described with reference to the accompanying drawings.

Figure 1:
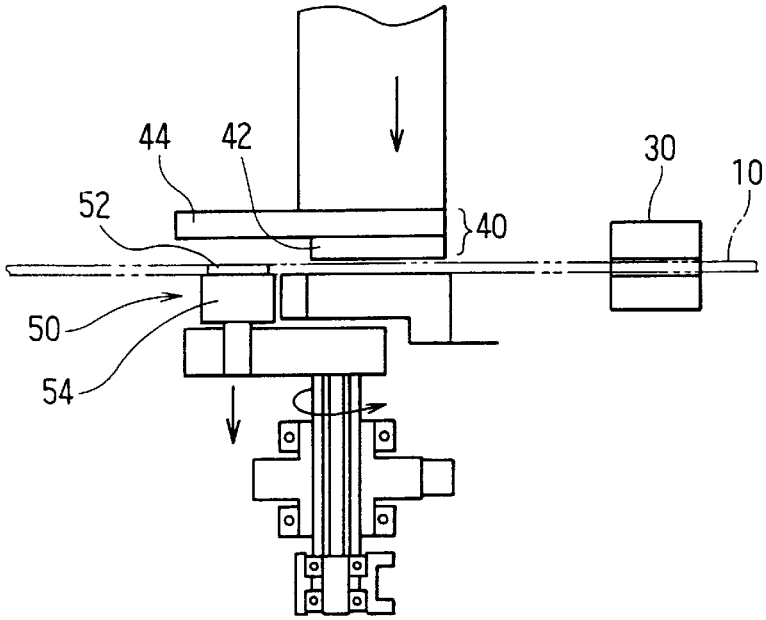
FIG. 1 is a side view showing a structure of a shaping device according to an embodiment.
Figure 2:
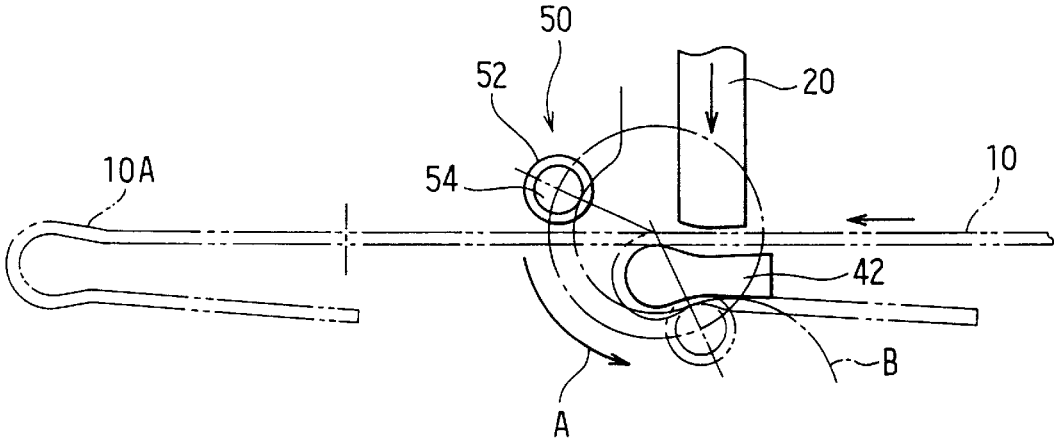
FIG. 2 is a plan cross-sectional view of the shaping device of FIG. 1 taken along a feeding plane of a conductor material.

As shown in FIGS. 1 and 2, the shaping device according to the present embodiment includes a holding portion 20 for holding a conductor material 10, a feeding portion 30 for feeding the conductor material 10, a core metal portion 40 forming a die that defines a shape and size of the conductor material 10 when the conductor material 10 is shaped into the U-shape, and a shaping portion 50 that shapes the conductor material 10 into the U-shape along the core metal portion 40. As illustrated in FIG. 2, the bend angle of the U-shape is greater than 180° such that a neck 10B is formed between a U-shaped segment 10C and a pair (first and second) of linear segments 10D.

The core metal portion 40 includes a core metal 42 and an upper guide 44. The core metal 42 forms the die, and the upper guide 44 acts as a first guide portion that restrains upward movement of the conductor material 10 during the shaping operation. The shaping portion 50 includes a shaping element 52 and a lower guide 54. The shaping element 52 shapes the conductor material 10 into the U-shape by urging the conductor material 10 along the core metal 42. The lower guide 54 acts as a second guide portion that restrains downward movement of the conductor material 10 during the shaping operation.

The above-described holding portion 20 is movable in a direction generally perpendicular to a feeding direction of the conductor material 10. The holding portion 20 holds the conductor material 10 by clamping the conductor material 10 between the holding portion 20 and the core metal 42. The feeding portion 30 feeds a predetermined length of the conductor material 10 required for each shaping operation at predetermined time intervals. Before initiating the shaping operation, the core metal portion 40 is moved downwardly to a predetermined operating position where the core metal 42 provided at a lower end of the core metal portion 40 reaches a feeding path of the conductor material 10. This position is a predetermined position of the core metal portion 40 during the shaping operation. The core metal portion 40 is moved upwardly after the shaping operation, so that the core metal portion 40 does not obstruct the feeding path of the conductor material 10 during the feeding operation of the conductor material 10. At the beginning of the shaping operation, the shaping portion 50 is placed at a predetermined operating position where the shaping element 52 provided at an upper end of the shaping portion 50 is placed at substantially the same level or height as that of the conductor material 10. During the shaping operation, the shaping portion 50 is moved such that the shaping element 52 of the shaping portion 50 is moved horizontally at this level along a predetermined planar path (arcuate path B shown in FIG. 2). After the shaping operation, the shaping portion 50 is moved downwardly, so that the shaping portion 50 does not obstruct the path of the conductor material 10 during the feeding operation of the conductor material 10.

The shaping device according to the present embodiment is constructed in the above manner. Next, the shaping operation of the U-shaped conductor carried out with the shaping device will be described below.

Figure 3:
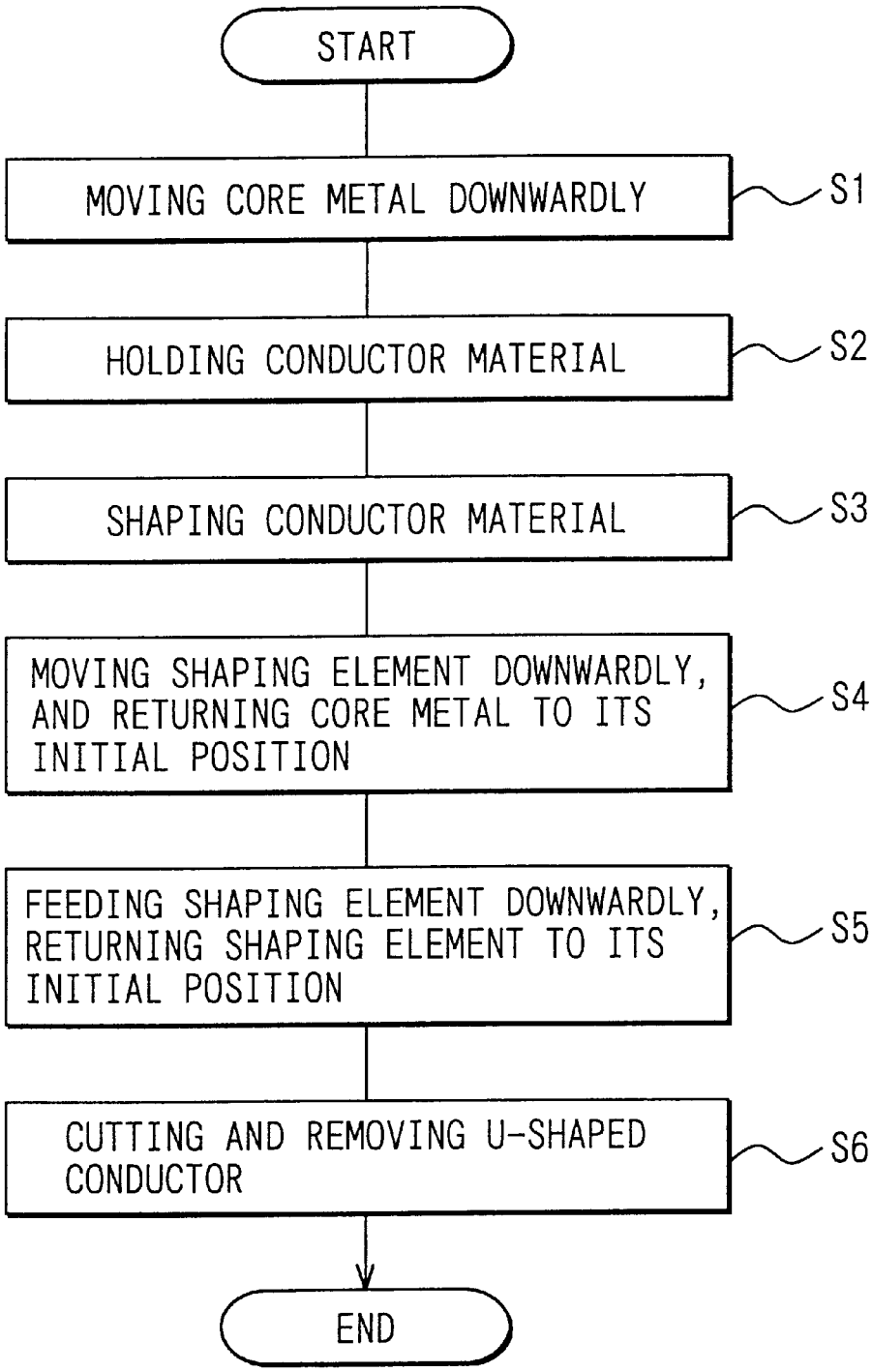
FIG. 3 is a flow chart showing a shaping operation for producing a U-shaped conductor according to the embodiment.
Figure 4:
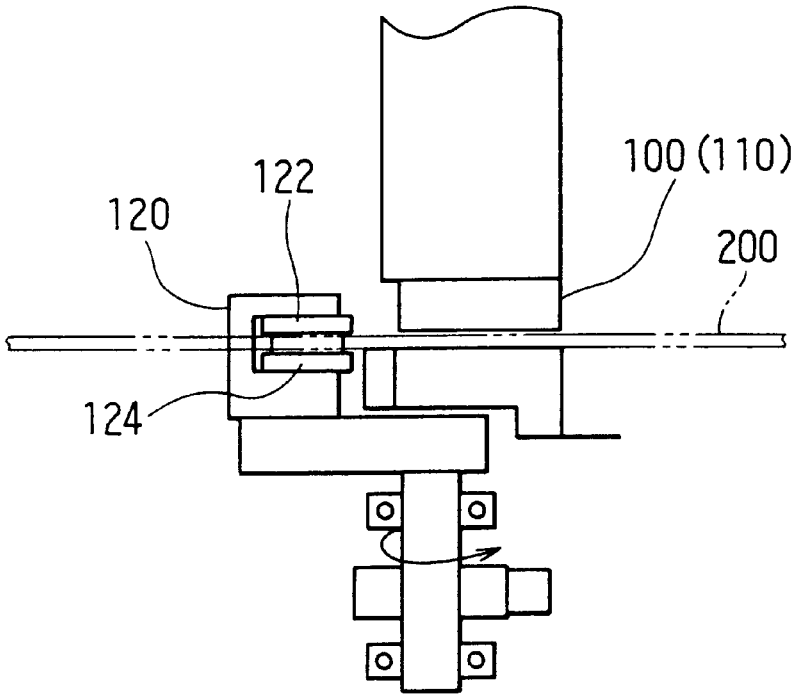
FIG. 4 RELATED ART
FIG. 4 is a view showing a structure of a previously proposed shaping device for producing the U-shaped conductor.

FIG. 3 is a flow chart showing the shaping operation of the U-shaped conductor according to the present embodiment.

(STEP S1) First, the core metal 42 is moved downwardly to the predetermined operating position and is secured thereat.

(STEP S2) Next, the conductor material 10 fed from the feeding portion 30 is held by the holding portion 20 by moving the holding portion 20 in a direction generally perpendicular to the feeding direction of the conductor material 10.

(STEP S3) Then, the conductor material 10 is shaped along the core metal 42 by moving the shaping element 52 in a direction indicated with an arrow A in FIG. 2.

(STEP S4) When the shaping element 52 reaches an end point of the shaping operation, the shaping element 52 moves downwardly or is retracted away from the conductor material 10, and the core metal 42 moves upwardly to return to its initial position.

(STEP S5) Next, the feeding portion 30 moves or removes the portion of the conductor material 10 that is shaped into the U-shape in the forward direction and simultaneously feeds a predetermined length of a new portion of the conductor material 10 to be shaped into the U-shape. The shaping element 52 is returned to its initial position where the shaping element 52 is held before the shaping operation.

(STEP S6) Then, the portion of the conductor material 10 that is shaped into the U-shape is cut and is removed as the U-shaped conductor 10A.

In this way, the U-shaped conductor 10A is produced in the shaping operation by bending the generally linear conductor material 10 into the U-shape. The provision of the upper guide 44 to the core metal 42 allows movement of the shaping element 52 toward the lower guide 54 side that is opposite to the upper guide 44. Thus, after the conductor material 10 is shaped into the U-shape, the shaping element 52 can be moved toward the lower guide 54 side, so that the U-shaped conductor 10A that is produced after the shaping operation can be moved forward. As a result, it is not required to wait for the shaping element 52 to return to its initial position, and thereby it is possible to reduce the time required for the U-shaped conductor 10A to be removed. In this way, the productivity can be improved.

The present invention is not limited to the above embodiment, various modifications of the above embodiment are possible within the scope of the present invention. For example, the shaping element 52 used in the above embodiment can be in a form of a roller that is freely rotatably supported. The roller acting as the shaping element 52 rotates freely during the shaping operation, so that formation of scratches on the surface of the conductor material 10 can be restrained when the roller moves along the surface of the conductor material 10 during the shaping operation. Particularly, in a case of a conductor material that has a film thereon, if scratches are formed on the film when the conductor material is shaped into the U-shape, dielectric property of the film is deteriorated. However, if the roller is used as the shaping element 52, the formation of the scratches is restrained, so that occurrence of insulation failure induced by the scratches, which are formed during the shaping operation, can be minimized.

Additional advantages and modifications will readily occur to those skilled in the art. The invention in its broader terms is therefore, not limited to the specific details, representative apparatus, and illustrative examples shown and described.

What is claimed is:

1. A shaping device for processing a conductor material into a U-shaped conductor, which has first and second linear segments and a generally U-shaped segment, wherein said U-Shaped segment has first and second ends respectively connected to said first and Second linear segments, wherein said U-shaped segment has a neck at said first and second ends, so that said U-shaped segment converges toward said neck, and said first and second linear segments diverge from said neck in a direction away from said neck, said shaping device comprising:

a holding portion for holding said conductor material;

a feeding portion for feeding said conductor material;

a core metal portion forming a die that defines a shape and size of said conductor material when said conductor material is shaped to form said U-shaped conductor, wherein said core metal portion includes a core metal that serves as said die, and said holding portion urges said conductor material against said core metal to clamp said conductor material between said holding portion and said core metal and bends said conductor material to shape one of said first and second ends of said U-shaped segment to form one side of said neck; and a shaping portion from shaping said conductor material to form said U-shaped conductor along said core metal, wherein said shaping portion includes a shaping element, end said shaping element bends said conductor material by urging said conductor material along at least a portion of said core metal, wherein:

said core metal and said shaping element are moveable away from each other in opposed first and second directions, respectively, to release said conductor material from said core metal and said shaping element after said shaping element bends said conductor material by urging said conductor material along at least said portion of said core metal; and said first and second directions are generally perpendicular to a plane in which bending of said conductor material occurs.

2. A shaping device according to claim 1, wherein said core metal portion further includes a first guide portion, which restrains movement of said conductor material in said first direction when said conductor material is shaped to form said U-shaped conductor;

said shaping portion further includes a second guide portion, which restrains movement of said conductor material in said second direction when said conductor material is shaped to form said U-shaped conductor.

3. A shaping device according to claim 2, wherein:

said first guide portion extends generally parallel to said plane from an end of said core metal on a side opposite from said shaping portion; and said second guide portion extends generally parallel to said plane from an end of said shaping element on a side opposite from said core metal portion.

4. A method for processing a conductor material into a U-shaped conductor, which has first and second linear segments and a generally U-shaped segment, wherein said U-shaped segment has first and second ends respectively connected to said first and second linear segments, wherein said U-shaped segment has a neck at said first and second ends, so that said U-shaped segment converges toward said neck, and said first and second linear segments diverge from said neck in a direction away from said neck, said method comprising steps of:

positioning a core metal of a core metal portion to a predetermined operating position, and securing said conductor material, which is fed to a predetermined position, by urging a holding portion against said core metal to clamp said conductor material between said holding portion and said core metal such that said holding portion bends said conductor material to shape one of said first and second ends of said U-shaped segment to form one side of said neck;

shaping said conductor material to form said U-shaped conductor by moving a shaping element of a shaping portion along a predetermined planar path such that said shaping element urges said conductor material along at least a portion of said core metal;

moving said core metal and said shaping element away from each other in opposed first and second directions, respectively, to release said conductor material from said core metal and said shaping element, wherein said first and second directions are substantially perpendicular to a plane in which said planar path of said shaping element is located;

cutting and removing said conductor material that is shaped into said U-shaped conductor.

5. A method according to claim 4, further comprising a step of returning said shaping element to its initial position after said step of moving said core metal and said shaping element away from each other to release, said conductor material from said core metal and said shaping element.

6. A method according to claim 5, further comprising a step of feeding said conductor material forward, said step of feeding said conductor material forward being carried out in parallel with said step of returning said shaping element to its initial position.

7. A shaping device for processing a conductor material into a U-shaped conductor, which has first and second linear segments and a generally U-shaped segment, wherein said U-shaped segment has first and second ends respectively connected to said first and second linear segments, wherein said U-shaped segment has a neck at said first and second ends, so that said U-shaped segment converges toward said neck, and said first and second linear segments diverge from said neck in a direction away from said neck, said shaping device comprising:

a holding portion for holding said conductor material;

a feeding portion for feeding said conductor material;

a core metal portion forming a die that defines a shape and size of said conductor material when said conductor material is shaped to form said U-shaped conductor, wherein said core metal portion includes a core metal that serves as said die, and a cross section of said core metal has a keyhole shape, which corresponds to a shape of said U-shaped conductor and includes a head section, a neck section and a diverging section, wherein said head section converges toward said neck section, and said diverging section diverges from said neck section in a direction away from said neck section; and a shaping portion for shaping said conductor material to form said U-shaped conductor along said core metal, wherein said shaping portion includes a shaping element, and said shaping element bends said conductor material by urging said conductor material along at least a portion of said core metal; wherein said core metal and said shaping element are movable away from each other in opposed first and second directions, respectively, to release said conductor material from said core metal and said shaping element after said shaping element bends said conductor material by urging said conductor material along at least said portion of said core metal; and said first and second directions are generally perpendicular to a plane in which bending of said conductor material occurs.

8. A shaping device according to claim 7, wherein said shaping element of said shaping portion is movable along an arcuate path in a plane, wherein a center of an arc of said arcuate path is offset from a center of said head section of said core metal.

9. A shaping device according to claim 7, wherein said holding portion urges said conductor material against said core metal to clamp said conductor material between said holding portion and said core metal and bends said conductor material to shape one of said first and second ends of said U-shaped segment to form one side of said neck.

10. A shaping device according to claim 7, wherein:

said core metal portion further includes a first guide portion, which restrains movement of said conductor material in a first direction when said conductor material is shaped to form said U-shaped conductor; and said shaping portion further includes a second guide portion, which restrains movement of said conductor material in a second direction that is opposite to said first direction when said conductor material is shaped to form said U-shaped conductor.

11. A shaping device according to claim 7, wherein said shaping element is a roller that is freely rotatably supported.

12. A shaping device according to claim 7, wherein:

said shaping element of said shaping portion is movable along an arcuate path in a plane to shape said U-shaped segment of said U-shaped conductor; and said shaping element of said shaping portion is also movable in a direction perpendicular to said plane.

13. A shaping device according to claim 10, Wherein:

said shaping element of said shaping portion is movable along an arcuate path in a plane to shape said U-shaped segment of said U-shaped conductor; and said first direction and said second direction extend perpendicular to said plane.

14. A shaping device according to claim 7, wherein:

said shaping element of said shaping portion is movable along an arcuate path in a plane to shape said U-shaped segment of said U-shaped conductor; and:

a travel end of said arcuate path of said shaping element of said shaping portion is located adjacent to one of said first and second ends of said U-shaped segment where said neck is formed.

15. A method for processing a conductor material into a U-shaped conductor, which has first and second linear segments and a generally U-shaped segment wherein said U-shaped segment has first and second ends respectively connected to said first and second linear segments, wherein said U-shaped segment has a neck at said first and second ends, so that said U-shaped segment converges toward said neck, and said first and second linear segments diverge from said neck in a direction away from said neck, said method comprising steps of:

positioning a core metal of a core metal portion to a predetermined operating position, and securing said conductor material, which is fed to a predetermined position, wherein a cross section of said core metal has a keyhole shape, which corresponds to a shape of said U-shaped conductor and includes a head section, a neck section and a diverging section, wherein said head section converges toward said neck section, and said diverging section diverges from said neck section in a direction away from said neck section;

shaping said conductor material to form said U-shaped conductor by moving a shaping element of a shaping portion along a predetermined planar path such that said shaping element urges said conductor material along at least a portion of said core metal;

moving said shaping element away from said conductor material in a direction substantially perpendicular to a plane, in which said planar path of said shaping element is located, and returning said core metal to its initial position; and cutting and removing said conductor material that is shaped into said U-shaped conductor.

16. A method according to claim 15, wherein said step of positioning said core metal of said core metal portion includes moving said core metal to said predetermined operating position in a direction generally perpendicular to said plane.

17. A method according to claim 15, wherein said planar path is an arcuate path, wherein a center of an arc of said arcuate path is offset from a center of said head section of said core metal.

18. A method according to claim 15, wherein said step of securing said conductor material includes urging a holding portion against said core metal to clamp said conductor material between said holding portion and said core metal such that said holding portion bends said conductor material to shape one of said first and second ends of said U-shaped segment to form one side of said neck.

19. A method according to claim 15, further comprising a step of returning said shaping element to its initial position after said step of moving said shaping element away from said conductor material in said direction substantially perpendicular to said plane.

20. A method according to claim 19, further comprising a step of feeding said conductor material forward, said step of feeding said conductor material forward being carried out in parallel with said step of returning said shaping element to its initial position.

21. A method according to claim 15, further comprising a step of moving said core metal away from said predetermined operating position in a direction generally perpendicular to said plane after said step of shaping said conductor material to form said U-shaped conductor.

22. A method according to claim 15, wherein said step of shaping said conductor material by moving said shaping element along said predetermined planar path is carried out while said conductor material is restricted from moving in a first direction by a first guide portion of said core metal portion and is also restricted from moving in a second direction that is opposite to said first direction by a second guide portion of said shaping portion, wherein said first direction and said second direction extend generally perpendicular to said plane.

23. A method according to claim 15, wherein said step of shaping said conductor material by moving said shaping element of said shaping portion along said predetermined path includes moving said shaping element of said shaping portion away from said first end of said U-shaped segment toward said second end of said U-shaped segment along an arcuate path, wherein a travel end of said arcuate path of said shaping element of said shaping portion is located adjacent to said second end of said U-shaped segment where said neck is formed.

24. A method for shaping a conductor material into a U-shape, said method comprising steps of:

positioning a core metal of a core metal portion to a predetermined operating position, and securing said conductor material fed to a predetermined position with use of a holding portion;

shaping said conductor material into said U-shape by moving a shaping element of a shaping portion along a predetermined planar path such that said shaping element urges said conductor material along at least a portion of said core metal;

moving said core metal and said shaping element away from each other in opposed first and second directions, respectively, to release said conductor material from said core metal and said shaping element, wherein said first and second directions are substantially perpendicular to a plane in which said planar path of said shaping element is located;

cutting and removing said conductor material that is shaped into said U-shape after moving said core metal and said shaping element away from said conductor material in said first and second directions, respectively.

* * * * *